US005988828A

United States Patent [19]

Prince et al.

[11] Patent Number: 5,988,828

[45] Date of Patent: Nov. 23, 1999

[54] PORTABLE LIGHT INCORPORATING A MULTI-POSITION HOOK

[75] Inventors: Michael D. Prince, Chicago, Ill.; Mark A. Carlson, Wauwatosa; Michael Schmidt, Brookfield, both of Wis.

[73] Assignee: Milwaukee Electric Tool Corporation, Brookfield, Wis.

[21] Appl. No.: 08/896,391

[22] Filed: Jul. 18, 1997

[51] Int. Cl.[6] ..... F21L 7/00

[52] U.S. Cl. ..... 362/191; 362/202; 362/199

[58] Field of Search ..... 362/191, 157, 362/194, 197, 199, 200, 202

[56] References Cited

U.S. PATENT DOCUMENTS

| | | | |
|---|---|---|---|
| 5,190,369 | 3/1993 | Pace | 362/186 |
| 5,213,412 | 5/1993 | Ciallella | 362/398 |
| 5,255,168 | 10/1993 | Stevens | 362/108 |
| 5,455,751 | 10/1995 | Lynch | 362/194 |

OTHER PUBLICATIONS

Makita 1992 Catalog, p. 14, showing Model ML700 incandescent flashlight.

SKIL Power Tool & Accessory Catalog, p. 61, available prior to Jul. 18, 1996, showing a Model HD2940:71 worklight.

DeWalt Product Specifications Document, available prior to Jul. 18, 1996, showing a Model DW902 cordless flashlight.

Photograph of Ryobi Torque Force Flashlight, Model TFF100, available prior to Jul. 18, 1996.

*Primary Examiner*—Sandra O'Shea
*Assistant Examiner*—Marshall Honeyman
*Attorney, Agent, or Firm*—Michael Best & Friedrich LLP

[57] ABSTRACT

A portable work light includes a main body having a light body and a power pack, and a hook implement that is detachably connected to the main body. The light body includes a head portion that retains a lighting element. The head portion is pivotally adjustable about an axis on a reference plane that is generally parallel to a bottom surface of the main body, and is pivotally adjustable to an angular position that is below the reference plane. A mount integrally formed with the main body is engageable with the hook implement to suspend the main body from the support. The mount has a slot that receives a boss portion of the hook implement and secures the boss portion in a detachably engaged position within the mount. The mount also has a maintaining means for maintaining connection of the hook implement to the mount when the work light is not being suspended. A second mount integrally formed with the main body may also be provided with the work light.

9 Claims, 5 Drawing Sheets

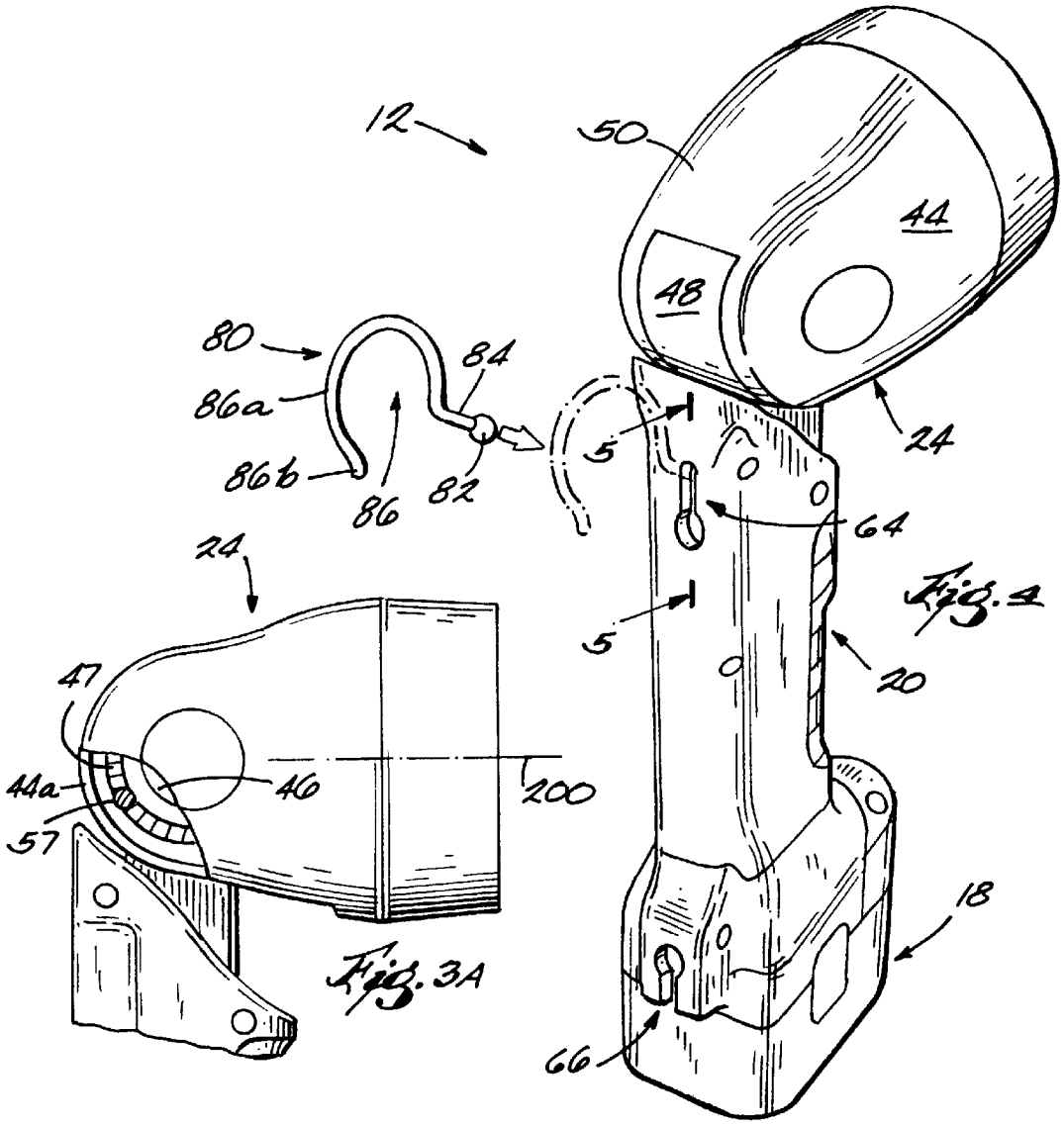
Fig. 4
Fig. 3A
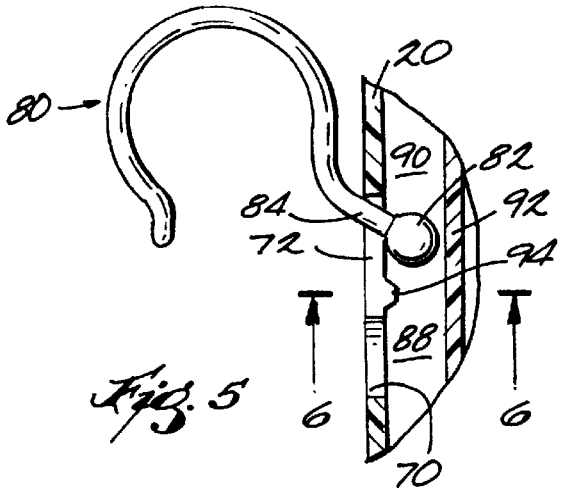
Fig. 5
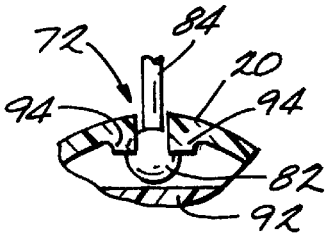
Fig. 6

PORTABLE LIGHT INCORPORATING A MULTI-POSITION HOOK

FIELD OF THE INVENTION

The present invention relates to portable work tools, and particularly to portable work lights for illuminating a work area.

BACKGROUND OF THE INVENTION

A portable work light is a light that has a dedicated power source and can be carried from one location to another without the use of an electrical cord. Portable work lights are available in a variety of designs. For example, a flashlight (one type of portable work light) typically has a cylindrical shape. One end of the flashlight retains a lighting element, and the opposite end houses several batteries. Flashlights and other portable lights may be used to illuminate work areas that are inaccessible to a fixed power source or cannot be reached by an extension cord. These lights may also be used to supplement or intensify the existing lighting at the work areas.

Traditional flashlights and other portable lights typically have a handle or grip by which the portable light may be engaged and positioned to illuminate an intended work area. In some situations, the desired work activity or task may be performed by one person while another person handles the portable work light and positions the light beam from the portable work light onto the work area. For some tasks, a person might hold the flashlight with one hand and hold a tool or work piece with the other hand.

There are also certain tasks that demand that the person use both hands to handle a tool and/or one or more work pieces. For these tasks, an ordinary flashlight may be propped up against a support and braced so as to direct the light beam from the light to the work area or work piece. If the work area or work piece is on a horizontal surface, the flashlight may also be laid down on the horizontal surface, near the work area or work piece, and braced against a solid support (e.g., between two books or next to a tool box) so as to maintain its position and so as to illuminate the work area or work piece. If the work area changes or the work piece must be moved, the flashlight must be repositioned and re-braced to illuminate the new work area or the new location of the work piece.

SUMMARY OF THE INVENTION

A portable work light according to the present invention comprises a main body and a hook implement. The main body includes a light body having a lighting element and a power pack having a power source that is electrically interconnectable with the lighting element. The hook implement is connected to the main body and is adapted to suspend the work light from a support. The hook implement may be connected to the main body so as to be detachable from the main body or so as to be movable relative to the main body.

The work light may also include a mount integrally formed with the main body. The mount is detachably engageable with a support member to suspend the work light from the support member and includes a slot that is adapted to receive at least a portion of the support member within the mount. The slot may be particularly adapted to engage a support member having a boss and may have an enlarged portion for receiving the boss and a reduced portion for securing the boss in a detachably engaged position within the mount. Preferably, the work light further includes a second mount integrally formed with the main body. In such case, the first and second mounts are preferably positioned such that the center of mass of the main body is substantially in between the two mounts.

The hook implement may also be detachably engageable with the mount to suspend the main body from a support. The hook implement can include a boss that may be received in the slot. Further, the mount may have a maintaining means for maintaining connection of the hook implement to the mount when the work light is not being suspended. For example, such a maintaining means may include at least one detent.

In another aspect, the present invention provides a portable work light having a head portion that is pivotably adjustable about an axis on a reference plane that is generally parallel to a bottom surface of the main body. The head portion will be pivotally adjustable to an angular position below the parallel plane. In one embodiment, the head portion is pivotally adjustable to an angular position that is about 30° below the reference plane and to an angular position that is about 90° above the reference plane. Further, the work light is provided with a means for maintaining the head portion at a plurality of angular positions within the range of angular positions. Such a maintaining means may include at least one detent.

BRIEF DESCRIPTION OF THE DRAWINGS

FIG. 3A is a partial cutout of the head portion illustrated in FIG. 3, illustrating a pin engaged with one of a set of detents.

FIG. 4 is a rear perspective view of the portable work light showing a hook implement disengaged from an upper mount and showing, in dash lines, the suspending implement engaged with the upper mount.

FIG. 5 is a vertical section taken along line 5—5 of FIG. 4.

FIG. 6 is a horizontal section taken along line 6—6 of FIG. 5.

DETAILED DESCRIPTION

Figure 1:
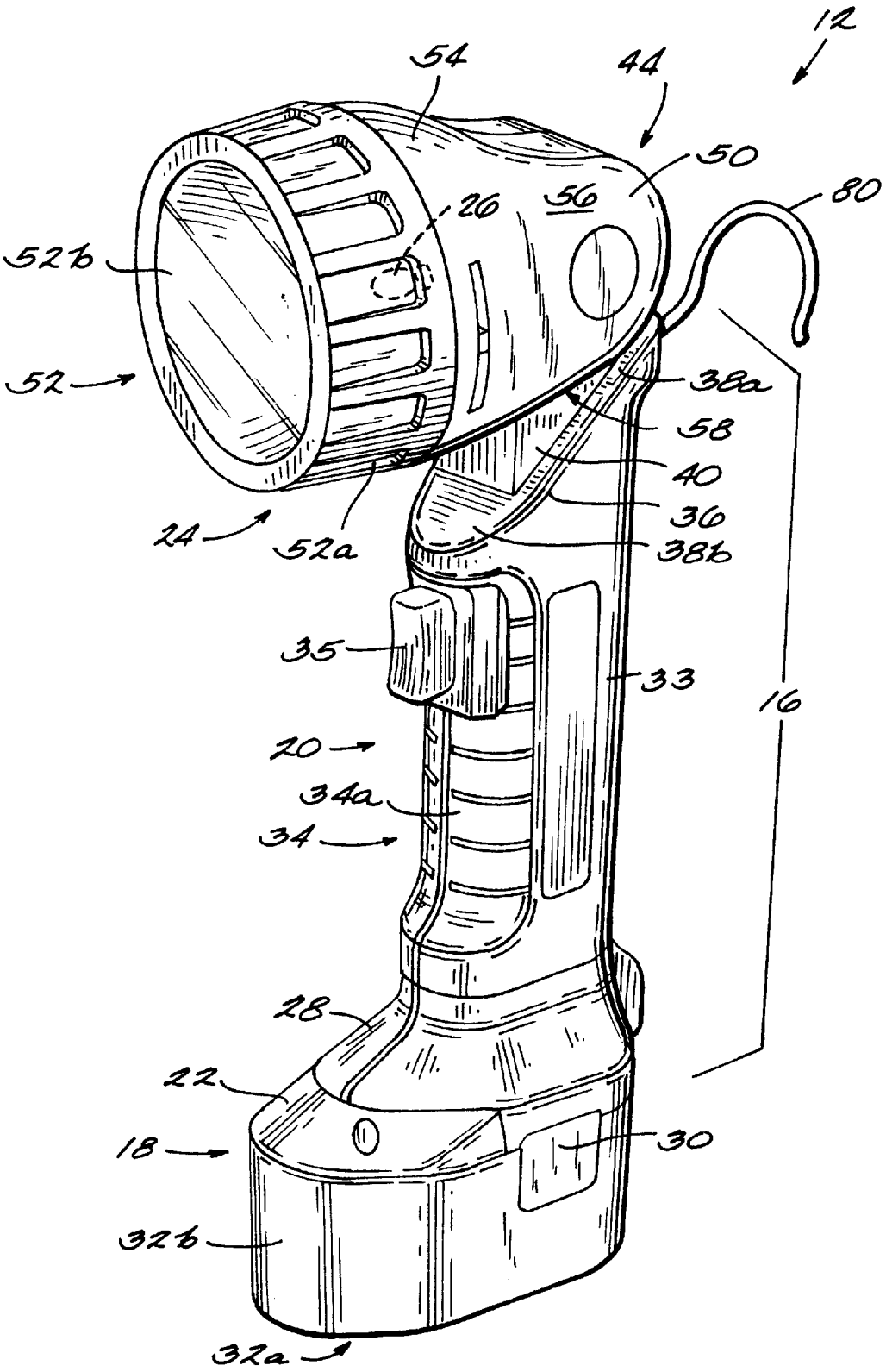
FIG. 1 is perspective view of a portable work light according to the present invention.

FIG. 1 illustrates a portable work light 12 embodying the invention. The work light 12 includes a main body comprising a light body 16 and a power pack 18. The light body 16 has a housing 20 that is detachably mounted to the power pack 18, and a head portion 24 that retains a lighting element 26. The head portion 24 is pivotably supported by the housing 20 such that the lighting element 26 may be placed in a position to illuminate a work area (or work piece). In FIG. 1, the main body is shown in the upright position and with the head portion 24 directed toward the front of the work light 12.

Figure 2:
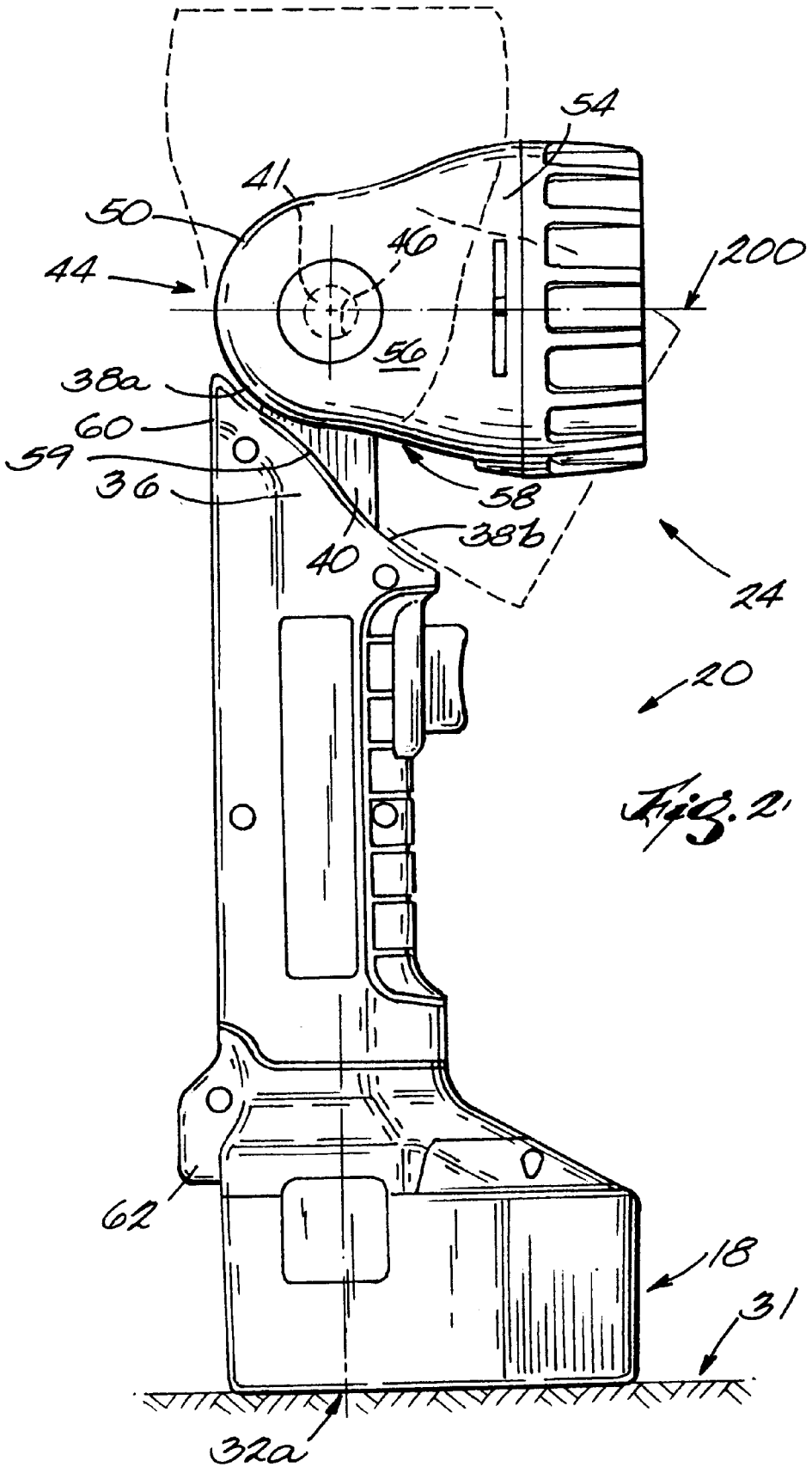
FIG. 2 is a side view of the portable work light of FIG. 1, with dashed lines illustrating the range of motion of a head portion of the portable work light.
Figure 3:
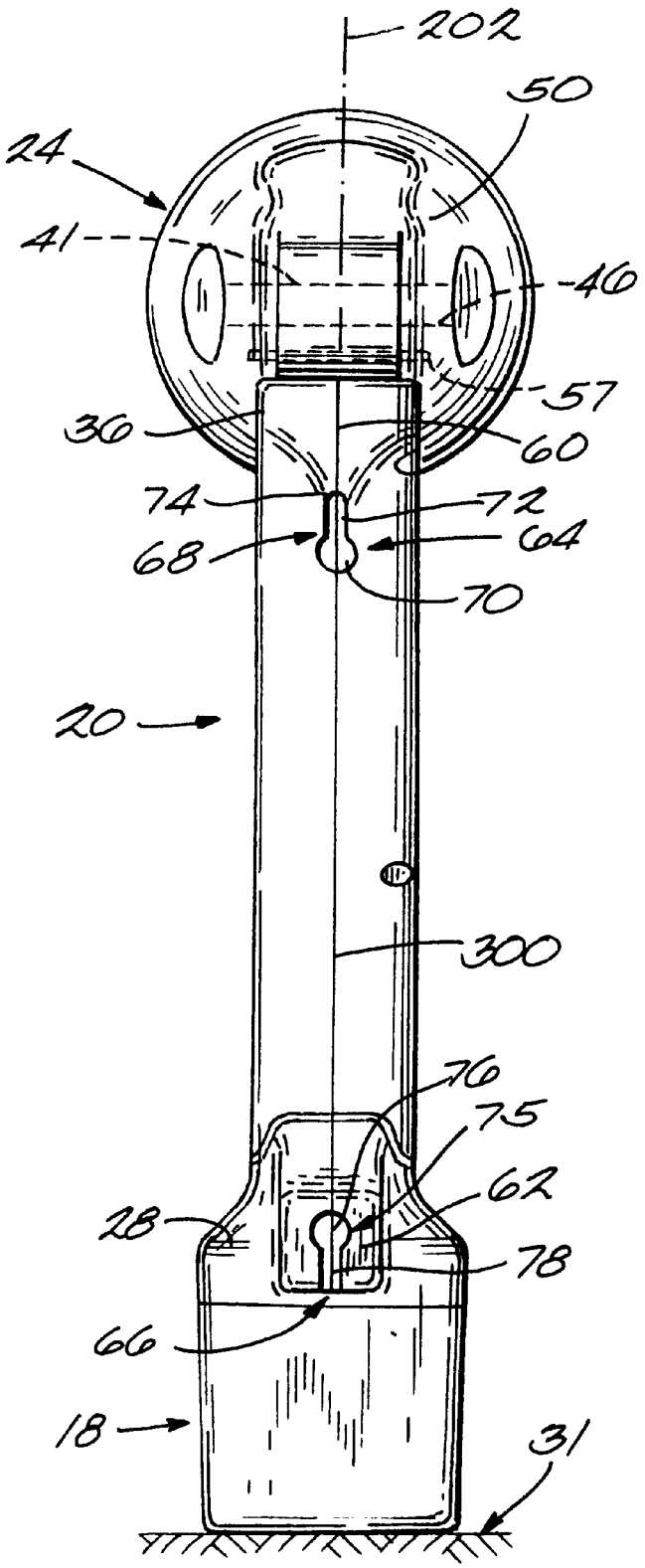
FIG. 3 is a rear view of the portable work light of FIG. 1.

The power pack 18 retains a power source (not shown) that may be electrically interconnected with the lighting element 26. The power pack 18 has a base portion 32 partly defined by a flat bottom surface 32*a* and upright walls 32*b*. The base portion 32 is structurally designed to support the weight of the work light 12 and allows the main body to be placed in the upright position on a generally flat surface 31, as shown in FIGS. 1–3. Moreover, because the flat bottom surface 32*a* provides a wide footprint and the power pack 18 has a relatively large mass, the head portion 24 may be pivotally adjusted through a plurality of angular positions without the main body tipping over. The power pack 18 also has a pair of movable mounting latches 30. The mounting latches 30 engage a bottom flange 28 of the housing 20, thereby detachably securing the light body 16 to the power pack 18.

The housing 20 has an elongated handle portion 33 that extends upwardly from the bottom flange 28 toward the head portion 24. Along the front of the work light 12, the handle portion 33 includes a grip 34 comprising a plurality of lateral, spaced apart ribs 34*a* and a trigger 35 controlling an on/off switch (not shown). By operating the trigger 35, the lighting element 26 may be selectively electrically interconnected with the power source. The cross section of the handle portion 33 is sufficiently reduced to facilitate the ability of the user to grab the work light 12 from around the back of the work light 12 and to manually engage the ribs 34*a* on the front and/or operate the trigger 35.

Referring to FIGS. 1 and 2, the housing 20 further includes a shoulder 36 above the handle portion 33. The shoulder 36 has a shoulder surface 38 facing the head portion 24 and is sloped down from the back of the work light 12 toward the front of the work light 12. The shoulder surface 38 includes an upper section 38*a* and a lower section 38*b*, each of the sections 38*a*, 38*b* having a distinct contour. A support column 40 extends from the middle of the shoulder surface 38 where it is aligned with a longitudinal axis of the housing 20. In alternative embodiments, the column 40 may be located elsewhere on the shoulder 36 or elsewhere on the light body 16.

The column 40 extends upwardly from the shoulder surface 38 to a recess (not shown) in the casing 44 of the head portion 24. The top of the column 40 supports a pin housing 46 positioned within the casing 44 (see FIGS. 2 and 3). The pin housing 46 receives a pin 41 that is connected to an inside wall of the casing 44, thereby supporting the head portion 24 on the column 40. Through the pin 41, the head portion 24 may be pivoted on the pin housing 46 and adjusted to a number of angular positions relative to the column 40 and housing 20.

Referring to FIGS. 3 and 4, the column 40 also has a curved back wall 48 that occupies a portion of the recess. As the head portion 24 is pivoted upwardly (i.e., toward the top of the work light 12), the casing 44 passes over the curved back wall 48. Moreover, the shape of the casing 44 is designed so as to partially conform with the shape of the curved back wall 48 and to accommodate the outer surface of the back wall 48 when the head portion 24 is pivoted upwardly.

Referring to FIG. 1, the underside 58 of the casing 44 is characterized by a slight concavity. As shown in the side view of FIG. 2, the outline of the shoulder surfaces 38*a*, 38*b* is designed to correspond closely with the outline of the underside 58, including the concavity. The upper section 38*a* and lower section 38*b* are shaped to be slightly convex and face the underside 58. The intersection of the upper section 38*a* with the lower section 38*b* forms a convex surface 59 that generally corresponds with the concave underside 58 of the head portion 24. As a result, the head portion 24 may be pivotally adjusted through a range of angular positions, without being obstructed by the shoulder 36.

Referring to FIG. 2, the head portion 24 may be pivotally adjusted through a range of angular positions equal to, or exceeding 120°. First, the head portion 24 may be pivoted down to a lower angular position of about 30° below an imaginary horizontal plane 200 that is parallel to the bottom surface 32*a* of the power pack 18. This lower angular position is shown in dashed lines in FIG. 2. At this lower angular position, the underside 58 of the head portion 24 is nearly adjacent to, and substantially conforms with, the shoulder surface 38*a*, 38*b*. Secondly, the head portion 24 may be pivoted to an upper angular position of about 90° above the horizontal plane 200. This position is also shown in dashed lines in FIG. 2. It should be noted that the head portion 24 may be adapted to be pivotably adjustable beyond the angular position of 30° below the horizontal plane 200 by making certain modifications to the light body 16. For example, the column 40 may be extended or the slope of the shoulder 36 may be made steeper.

Another feature of the work light 12 is a means for maintaining the angular position of the head portion 24 after the head portion 24 is pivotally adjusted. Referring to FIG. 3A, the maintaining means includes a set of detents 47 (preferably two sets) that engage a spring-loaded pin 57. The detents 47 are arranged in a semi-circular fashion on the inside wall 44*a* of the casing 44 and are uniformly spaced from the pin housing 46. The spring-loaded pin 57 is substantially disposed within a groove 59 provided in the column 40 and has one end that projects from the groove 59 to engage the detents 47.

As the head portion 24 is rotated, the detents 47 ride over the projecting end of the spring-loaded pin 57, thereby compressing the spring-loaded pin 57. When the head portion 24 arrives at the desired angular position, the spring-loaded pin 57 is allowed to project into the space between two successive detents 47, thereby securing the head portion 24. The detents 47 are sized and spaced apart such that the head portion 24 may be positioned at uniform angular intervals. In the embodiment illustrated, the detents 47 are designed so that the head portion 24 may be maintained at angular positions of about 10° intervals between 0° and about 120°. In alternative embodiments, the means for maintaining the angular position may be provided by a retractable pin, a locking or latching device, or similar means.

The lighting element 26 is retained within a head portion 24 includes a protective cover 52 that is formed by a bezel 52*a* threaded to the casing 44, and a transparent lens 52*b*. The lighting element 26 is positioned within the protective cover 52. A power source (not shown) retained within the power pack 18 is electrically interconnected with the light body 16 and the head portion 24 to power the lighting element 26.

Referring to FIG. 3, the work light 12 is also equipped with a pair of flat surfaces or pedestals 60, 62 on the back of the main body for supporting the work light 12 on a surface. The upper pedestal 60 is integrally formed with the housing 20 just below the shoulder 36. The lower pedestal 62 is integrally formed with the bottom flange 28. Note that the work light 12 is generally structurally symmetrical about an imaginary vertical plane 202 that cuts through the middle of the housing 20 and through the center of the two pedestals 60, 62. This general symmetry allows the work light 12 to be supported on a generally flat surface via the two pedestals 60, 62 without the work light 12 tipping over to a side. Moreover, the head portion 24 may be pivotally adjusted through a range of angular positions while the work light 12 is supported on the two pedestals 60, 62 and without the work light 12 tipping. When the work light 12 is supported on a generally horizontal surface, for example, the head portion 24 may be pivoted to a first angular position so as to illuminate a work area directly in front of the work light 12 (i.e., wherein the head portion 24 is about 90° from the horizontal surface). Conversely, the head portion 24 may be pivoted to a second angular position so as to illuminate a work area ahead of the work light 12 and on the flat surface (i.e., wherein the head portion 24 and the housing 20 are nearly parallel with the horizontal surface).

Another feature of the portable work light 12 is provided by a means, integral with the main body , for suspending the main body from a support member. The suspending means allows the user to store the work light 12 in a suspended position or to place the work light 12 in position to illuminate a work area.

Referring to FIG. 3, the illustrated suspending means includes an upper mount 64 that is integrally formed with the housing 20 just below the upper pedestal 60. The upper mount 64 is adapted to be engaged with a support member, such as a nail extending from an upright wall or a hanging device (e.g., a hook) suspended from a ceiling, to suspend the work light 12 therefrom. The upper mount 64 includes a slot 68 having an enlarged opening 70. The enlarged opening 70 is sized to receive part of the support member into the main body and beneath the housing 20. The slot 68 also has an elongated section 72 that has a slot width substantially smaller than the diameter of the enlarged opening 70. The elongated section 72 begins at the enlarged opening 70 and extends upwardly therefrom to a closed end 74. As will be explained in greater detail below, the upper mount 64 is specially adapted to receiving a boss portion of a support member (e.g., the nail head of a nail) through the enlarged opening 70 and securing the boss portion beneath the elongated section 72 when the work light 12 is suspended from the support member. In alternative embodiments, the upper mount 64 may be located elsewhere on the main body , including on the head portion 24 or on the power pack 18.

The illustrated suspending means also includes a lower mount 66 that is integrally formed with the bottom flange 28 (See FIG. 3). Like the upper mount 64, the lower mount 66 has a slot 75 with an enlarged opening 76 for receiving part of a support member and an elongated section 78 extending from the enlarged opening 76. The lower mount 66 is upside down relative to the upper mount 64. A boss portion of the support member may be received in the enlarged opening 76 and secured by the elongated section 78 to suspend the work light 12 such that the head portion 24 is disposed below the support member. Alternatively, the work light 12 may be suspended by an extended support member received in the enlarged opening 76, and wherein the head portion 24 is above the support member.

It should be noted that whether the work light 12 is suspended by the first mount 64 or the second mount 66, or with the head portion 24 above or below the support member, the head portion 24 may be pivoted through a range of angular positions relative to the support member. Accordingly, the work light 12 may be positioned to illuminate a work area that is substantially above, substantially below, or in front of the work light 12 and the support member.

Referring to FIGS. 4 through 6, the work light 12 also includes a hook implement 80 that is engageable with each of the upper mount 64 and the lower mount 66 to suspend the main body from a support member. The hook implement 80 has a boss member 82 at one end, a stem portion 84 connected to the boss member 82, and a bent or hook member 86 at an opposite end. However, it will be apparent to one skilled in the art that the upper mount 64 and the lower mount 66 of the present invention are individually engageable with other varieties of suspending implements having some, or even none, of the attributes of the hook implement 80 described here and illustrated in the figures.

Referring to FIGS. 4 and 5, the hook member 86 is defined by a substantially curved section 86*a* and a leading tip portion 86*b*. The tip portion 86*b* is designed to engage a support having a flat surface such as a table, or a support having a slot or aperture. The curved section 86*a*, on the other hand, is specially adapted for engaging, or being draped over, a beam-like structure such as a suspended hook, a chain link, or a nail.

FIGS. 4 through 6 illustrate how the hook implement 80 may be engaged with the upper mount 64 of the main body . Note from FIG. 5 that the diameter of the enlarged opening 70 is greater than the diameter of the boss member 82. Accordingly, the boss member 82 may be passed through the enlarged opening 70 and into a receiving compartment or receiver 88 directly beneath the enlarged opening 70. A passageway 90 defined by the housing 20 and an internal wall 92 extends upwardly from the receiver 88 and beneath the elongated section 72. Note from FIG. 6 that the width of the elongated section 72 is greater than the diameter of the stem portion 84 but substantially smaller than the diameter of the boss member 82. Therefore, the boss member 82 may be slid from the receiver 88 into the passageway 90 while the stem portion 84 is simultaneously slid into the elongated section 72.

The upper mount 64 includes a pair of detents 94 positioned on the inside of the housing 20, between the passageway 90 and the receiver 88 (see FIGS. 5 and 6). The clearance between the detents 94 and the internal wall 92 is smaller than the diameter of the boss member 82. Therefore, to slide the boss member 82 from the receiver 88 into the passageway 90, the boss member 82 must be forced over the detents 94. To facilitate the process, the internal wall 92 may be made depressible (e.g., provided with a slit down the middle) such that the section yields to the boss member 82 and allows the boss member 82 to pass into the passageway 90. The section then returns to form after the boss member 82 passes.

After the boss member 82 is placed in the engaged position within the passageway 90, the detents 94 cooperate with the internal wall 92 to secure the boss member 82 within the passageway 90, even when the work light 12 is not suspended by the hook implement 80. The detents 94 prevent the boss member 82 from slipping back into the receiver 88 while the reduced width of the elongated section 72 prevents the boss member 82 from slipping through the slot 68. To disengage the hook implement 80 from the upper mount 64, the user must grab the hook implement 80 and force the boss member 82 back over the detents 94 and into the receiver 88. The boss member 82 may then be removed from the upper mount 64 through the enlarged opening 70.

An important feature of the work light 12 is that the boss member 82 of the hook implement 80 is freely rotatable within the passageway 90 of the upper mount 64. Therefore, when the main body is suspended from a support member, the main body may be rotatably adjusted about the boss member 82 so that the head portion 24 is directed to illuminate a particular work area. Note also that after the main body is rotated to the desired position, the head portion 24 may be pivotably adjusted through its allowable range of angular positions. In this way, the work light 12 is operable to illuminate almost any work area in the vicinity of the support member and within the illumination range of the lighting element 26.

A related feature of the work light 12 is that the hook implement 80 may be engaged in a number of positions within the upper mount 64. For example, in FIGS. 4 and 5, the hook implement 80 is positioned such that the hook 86 faces away from the main body rather than towards the head portion 24. From this position, the hook element 80 is particularly adapted to engage a support, for example a flange or a slot on a wall behind the work light 12, or a flat surface above the work light 12. The hook 86 may also be draped over another hook, through a chain link, or over a beam. Alternatively, the hook implement 80 in FIGS. 4 and 5 may be routed ¼ turn in either direction such that the hook 86 is turned sideways. From this position, the hook implement 80 is particularly adapted to engage an extended support member such as a nail head or a cantilever beam. Further, the hook implement 80 of FIGS. 4 and 5 may be rotated ½ turn such that the hook 86 is particularly adapted to engage a support member overhead of the housing 20.

Another feature of the work light 12 is that the hook implement 80 is engagable with either the lower mount 66 or the upper mount 64 to suspend the main body 12 from a support member. Like the upper 64, the lower mount 66 has a pair of detents (not shown) for maintaining the boss member 82 within the lower mount 66 whenever the main body is not suspended from a support member. In most respects, the hook implement 80 cooperates with the lower mount 66 in a manner similar to that with the upper mount 64. One difference between the upper mount 64 and the lower mount 66 is that the elongated section 78 of the lower mount 66 is below the enlarged opening 76. Accordingly, when the main body is suspended from the lower mount 66, the head portion 24 is disposed advantageously below the support member (see FIG. 7).

Figure 8:
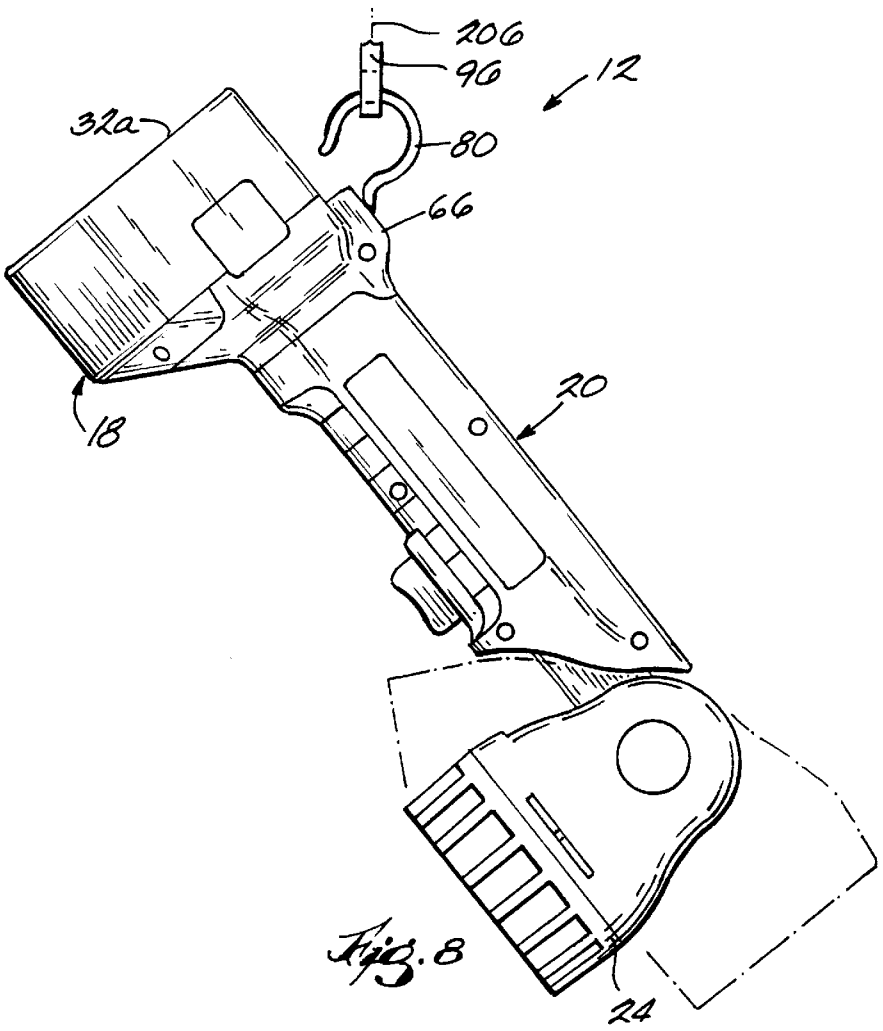
FIG. 8 illustrates the portable work light of FIG. 1 suspended by the suspending implement engaging a lower mount.
Figure 7:
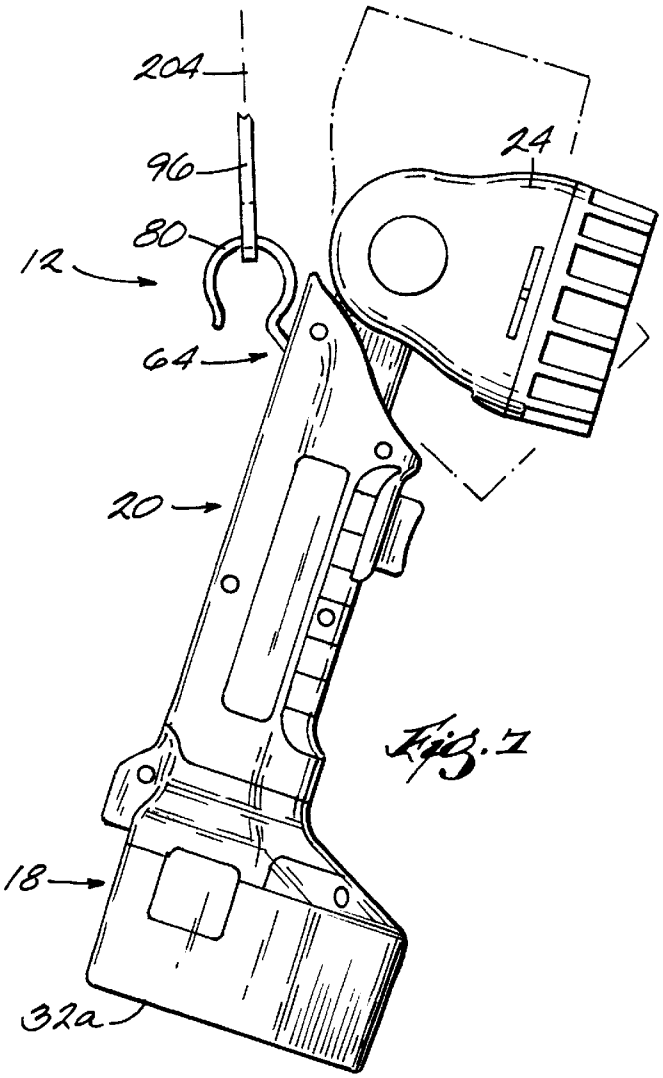
FIG. 7 illustrates the portable work light of FIG. 1 suspended by the suspending implement engaging the upper mount.

FIGS. 7 and 8 illustrate the flexibility of the work light 12 to illuminate a work area while suspended from a support member. In FIG. 7, the main body is suspended from a chain link 96 above the work light 12 using the upper mount 64. The housing 20 is disposed at an angular position of about 15° from an imaginary vertical plane 204 that intersects the axis of the chain link 96. As shown, the head portion 24 is disposed in a 90° angular position relative to the housing 20 or about 115° below the vertical plane 204 . From this position, the head portion 24 is directed to illuminate a work area that is to the right of the chain link 96. However, the head portion 24 may be pivotally adjusted to an upper angular position where the head portion 24 is substantially aligned with the housing 20, i.e., an angular position of about 15° from the vertical plane 204 (shown in dashed lines). Further, the head portion 24 is pivotally adjustable to a lower angular position of about 135° from the vertical plane 204 (shown in dashed lines).

In FIG. 8, the main body is again suspended from the chain link 96 as in FIG. 7, but with the hook implement 80 now engaged with the lower mount 66. The housing 20 is disposed at an angular position of about 135° from an imaginary vertical plane 206 that intersects the axis of the chain link 96. The head portion 24 is disposed at an angular position of about 90° relative to the housing 20 or about 225° from the vertical plane 206. From this position, the head portion 24 is directed to illuminate a work area that is to the left of the chain link 96. Further, the head portion 24 may be pivotally adjusted between a first angular position of about 135° from the vertical plane 206 and a second angular position of about 255° from the vertical plane 206.

FIGS. 7 and 8 illustrate how the work light 12 may be positioned to illuminate a work area that is to the left or to the right of the chain link 96, or even below the chain link 96. Note however that the main body is freely rotatable about the hook implement 80 and about the vertical axis of the chain link 96. Thus, the work light 12 may be positioned to illuminate any work area in the vicinity of the chain link 96 and within the illuminating range of the lighting element 26, using either the upper mount 66 or the lower mount 64.

In alternative embodiments, the upper mount 64 and the lower mount 66 may be placed at different locations on the main body so as to obtain a different set of functional suspended positions for the main body. Moreover, the head portion 24 and the housing 20 may be designed differently so that the head portion 24 can be pivotally adjusted through a different range of angular positions relative to the housing 20, that range being less than or greater than 120°.

While several embodiment of the present invention has been shown and described, alternate embodiments will be apparent to those skilled in the art and are within the intended scope of the present invention. Therefore, the invention is to be limited only by the following claims:

What is claimed is:

1. A portable work light comprising:

a main body including a light body having a lighting element, and a power pack including a power source that is electrically interconnectable with said lighting element;

a hook implement connected to said main body, said hook implement adapted to suspend said work light from a support; and a mount integrally formed with said main body, said hook implement being detachably engaged with said mount;

wherein said mount includes a connection maintaining means for maintaining connection of said hook implement to said mount when said work light is not being suspended, and wherein said connection maintaining means includes at least one detent.

2. A portable work light comprising:

a main body including a light body having a lighting element, and a power pack including a power source that is electrically interconnectable with said lighting element;

a hook implement connected to said main body, said hook implement adapted to suspend said work light from a support;

a first mount integrally formed with said main body, said hook implement being detachably engaged with said first mount; and a second mount integrally formed with said main body, said hook implement being detachable from said first mount and detachably engageable with said second mount to suspend said work light from the support.

3. The work light of claim 2, wherein said main body has a center of mass, said center of mass being located substantially between said first mount and said second mount.

4. A portable work light comprising:

a light body having a lighting element;

a power pack including a power source that is electrically interconnectable with said lighting element; and a mount integrally formed with one of said light body and said power pack, and detachably engageable with a support member to suspend the work light from the support member, said mount including a slot that is adapted to receive at least a portion of the support member within said mount;

wherein said mount is adapted to engage a support member having a boss, and wherein said slot includes an enlarged portion for receiving the boss, and a reduced portion that is cooperable with said boss to secure the boss in a detachably engaged position within said mount.

5. A portable work light comprising:

a light body having a lighting element;

a power pack including a power source that is electrically interconnectable with said lighting element;

a first mount integrally formed with one of said light body and said power pack, and detachably engageable with a support member to suspend the work light from the support member, said first mount including a slot that is adapted to receive at least a portion of the support member within said first mount; and a second mount integrally formed with said main body, said second mount being detachably engageable with the support member to suspend the work light from the support member.

6. The work light of claim 5, wherein said main body has a center of mass, said center of mass being located substantially between said first mount and said second mount.

7. A portable work light comprising:

a main body including a light body having a lighting element, a power pack including a power source that is electrically interconnectable with said lighting element, and a generally flat bottom surface for supporting said work light on a surface; and a hook implement connected to said main body, said hook implement adapted to suspend said work light from a support;

wherein said work light is selectively supportable by said bottom surface on a surface and by said hook implement from a support.

8. The work light of claim 7, wherein said light body further includes a head portion retaining said lighting element, said head portion being pivotally adjustable about an axis between a first angular position and a second angular position.

9. The work light of claim 7, wherein said head portion is pivotally adjustable within a range of angular positions, and wherein said work light further comprises position maintaining means for maintaining said head portion at a plurality of angular positions within said range of angular positions, said position maintaining means including at least one detent.

* * * * *